US008336964B2

(12) United States Patent
Cho

(10) Patent No.: US 8,336,964 B2
(45) Date of Patent: Dec. 25, 2012

(54) BEANBAG SOFA WITH RETRACTABLE HEADREST

(75) Inventor: Ho Joon Cho, Sungnam-si (KR)

(73) Assignee: Interpeople Co., Ltd., Seongnam (KR)

( * ) Notice: Subject to any disclaimer, the term of this patent is extended or adjusted under 35 U.S.C. 154(b) by 0 days.

(21) Appl. No.: 13/144,922

(22) PCT Filed: Jan. 29, 2010

(86) PCT No.: PCT/KR2010/000560

§ 371 (c)(1),
(2), (4) Date: Jul. 15, 2011

(87) PCT Pub. No.: WO2010/117131

PCT Pub. Date: Oct. 14, 2010

(65) Prior Publication Data

US 2011/0272989 A1 Nov. 10, 2011

(30) Foreign Application Priority Data

Apr. 9, 2009 (KR) ..... 20-2009-0004154 U

(51) Int. Cl.
*A47C 7/14* (2006.01)

(52) U.S. Cl. ..... 297/452.17

(58) Field of Classification Search ..... 297/452.17, 297/284.1

See application file for complete search history.

(56) References Cited

U.S. PATENT DOCUMENTS 3,899,210 A * 8/1975 Samhammer et al. ..... 297/448.2

(Continued)

FOREIGN PATENT DOCUMENTS

KR 20-0387044 Y1 6/2005
KR 20-0426952 Y1 9/2006

OTHER PUBLICATIONS

International Search Report dated Sep. 6, 2010, issued in PCT/KR2010/000560, filed Jan. 29, 2010.

*Primary Examiner* — Milton Nelson, Jr.
(74) *Attorney, Agent, or Firm* — Christensen O'Connor Johnson Kindness PLLC

(57) ABSTRACT

The present invention relates to a beanbag sofa with a retractable headrest, and more particularly, to a beanbag sofa with a retractable headrest, which is configured to interpose an auxiliary outer cover having a predetermined size and communicating with an outer cover in a predetermined position of the outer cover, so that a filling material filled in the outer cover can be introduced toward an interior of the auxiliary outer cover upon opening the auxiliary outer cover, thereby selectively forming a headrest and armrests as required for a user's convenience.

A beanbag sofa with a retractable headrest according to the present invention for achieving the objects comprises an outer cover for defining an external shape of the beanbag sofa, the outer cover having a U-shaped cut portion formed at a position of the outer cover with which the head of a user is in contact when a user sits on the beanbag sofa; an auxiliary outer cover connected to the U-shaped cut portion to be received in the outer cover or protrude; an open/close member formed along the cut portion to receive the auxiliary outer cover in the outer cover or to expose the auxiliary outer cover; and a filling material filled in the outer cover, wherein when the user sits on the beanbag sofa with the auxiliary outer cover exposed by opening the open/close member, the filling material is introduced toward the auxiliary outer cover to form the headrest.

3 Claims, 6 Drawing Sheets

U.S. PATENT DOCUMENTS 4,011,611 A 3/1977 Lederman
4,027,888 A * 6/1977 Wilcox ..... 297/452.17
4,281,873 A * 8/1981 Holland ..... 297/118
5,816,657 A 10/1998 Hecht
6,899,387 B2 * 5/2005 Ariizumi ..... 297/181
2003/0151295 A1 * 8/2003 Nelson ..... 297/452.17

* cited by examiner

BEANBAG SOFA WITH RETRACTABLE HEADREST

BACKGROUND OF THE INVENTION

1. Field of the Invention

The present invention relates to a beanbag sofa with a retractable headrest, and more particularly, to a beanbag sofa with a retractable headrest, which is configured to interpose an auxiliary outer cover having a predetermined size and communicating with an outer cover in a predetermined position of the outer cover, so that a filling material filled in the outer cover can be introduced toward an interior of the auxiliary outer cover upon opening the auxiliary outer cover, thereby selectively forming a headrest and armrests as required for a user's convenience.

2. Description of the Related Art

Generally, a sofa is a long chair having a backrest and armrests. Conventionally, the sofa is configured to include a wooden frame and an elastic material such as a sponge encompassing the wooden frame, so that a user may comfortably rest on the sofa.

Sofas may be classified into a leather sofa, an artificial leather sofa, a fabric sofa, and the like depending on a material of an outer cover for protecting the elastic material encompassing the frame. Alternatively, depending on its function, sofas may be classified into a reception sofa which may serve as a chair itself, a bed sofa which may serve as not only a chair itself but also a bed, a reclining sofa in which an angle of the backrest of the sofa may be adjusted using an electrically-driven means, and the like.

Further, there is a beanbag sofa as a kind of sofa in which an outer cover is filled with a filling material in order to serve as an easy chair without using a frame which would define an external shape of the sofa.

It would be better that such a beanbag sofa makes a user suitably comfortable and is light in weight in order to facilitate the carriage and handling thereof.

According to a conventional beanbag sofa, unlike the general sofa, an outer cover has been filled with a filling material, wherein expandable polystyrene particles are used as the filling material except for an elastic material having a restoring force such as sponge, so that the beanbag sofa may be easily deformed depending on an applied pressure. As a result, the beanbag sofa may be configured to be deformed in various forms depending on the posture of the user.

However, the above related art has the problems in that even if the beanbag sofa has been used to replace a chair, there is a disadvantage in that it is difficult for a user to keep a comfortable posture for a long time since the conventional beanbag sofa does not have any convenient means such as a headrest or armrests which would be formed in the chair.

Further, if such a beanbag sofa is manufactured largely enough to support the head of the user, there is a disadvantage in that due to the volumetric increase in the beanbag sofa, the manufacturing cost and the physical distribution cost may relatively increase and the space available for the beanbag sofa may be limited.

SUMMARY OF THE INVENTION

The present invention is conceived to solve the aforementioned problems. An object of the present invention is to provide a beanbag sofa with a retractable headrest, which is configured to form an auxiliary outer cover having a predetermined size and communicating with an outer cover in a predetermined position of the outer cover, e.g., in portions of the outer cover in which the head and/or both arms of the user may be positioned when the user sits on the beanbag sofa and to allow an open/close member to receive the auxiliary outer cover in the outer cover, so that when the user sits on the beanbag sofa with the auxiliary outer cover exposed out of the outer cover by opening the open/close member as required for the user's convenience, a filling material may be introduced toward an interior of the exposed auxiliary outer cover to form a headrest and/or armrests, thereby taking a convenient and comfortable rest without any inconvenience for a long time.

A beanbag sofa with a retractable headrest according to the present invention for achieving the objects comprises an outer cover for defining an external shape of the beanbag sofa, the outer cover having a U-shaped cut portion formed at a position of the outer cover with which the head of a user is in contact when a user sits on the beanbag sofa; an auxiliary outer cover connected to the U-shaped cut portion to be received in the outer cover or protrude; an open/close member formed along the cut portion to receive the auxiliary outer cover in the outer cover or to expose the auxiliary outer cover; and a filling material filled in the outer cover, wherein when the user sits on the beanbag sofa with the auxiliary outer cover exposed by opening the open/close member, the filling material is introduced toward the auxiliary outer cover to form the headrest.

In addition, a beanbag sofa with a retractable headrest according to the present invention for achieving the objects comprises an outer cover for defining an external shape of the beanbag sofa, the outer cover having three U-shaped cut portions respectively formed at three positions of the outer cover with which the head and both arms of a user are in contact when a user sits on the beanbag sofa; three auxiliary outer covers respectively connected to the U-shaped cut portions to be received in the outer cover or protrude; three open/close members formed along the U-shaped cut portions to receive the auxiliary outer covers in the outer cover or to expose the auxiliary outer covers, respectively; and a filling material filled in the outer cover, wherein when the user sits on the beanbag sofa with the auxiliary outer covers exposed by opening the three open/close members, respectively, the filling material is introduced toward the auxiliary outer covers to form the headrest and two armrests.

Since the beanbag sofa with the retractable headrest according to the present invention is configured to include the auxiliary outer cover formed in a predetermined position of the outer cover defining an external shape of the beanbag sofa to form a convenient means such as the headrest or the armrests by introducing a filling material filled in the beanbag sofa toward an interior of the auxiliary outer cover, the user may use the convenient means selectively as required for the user's convenience without increasing the total volume of the beanbag sofa, whereby the user may take a convenient and comfortable rest without any inconvenience for a long time

Figure 1:
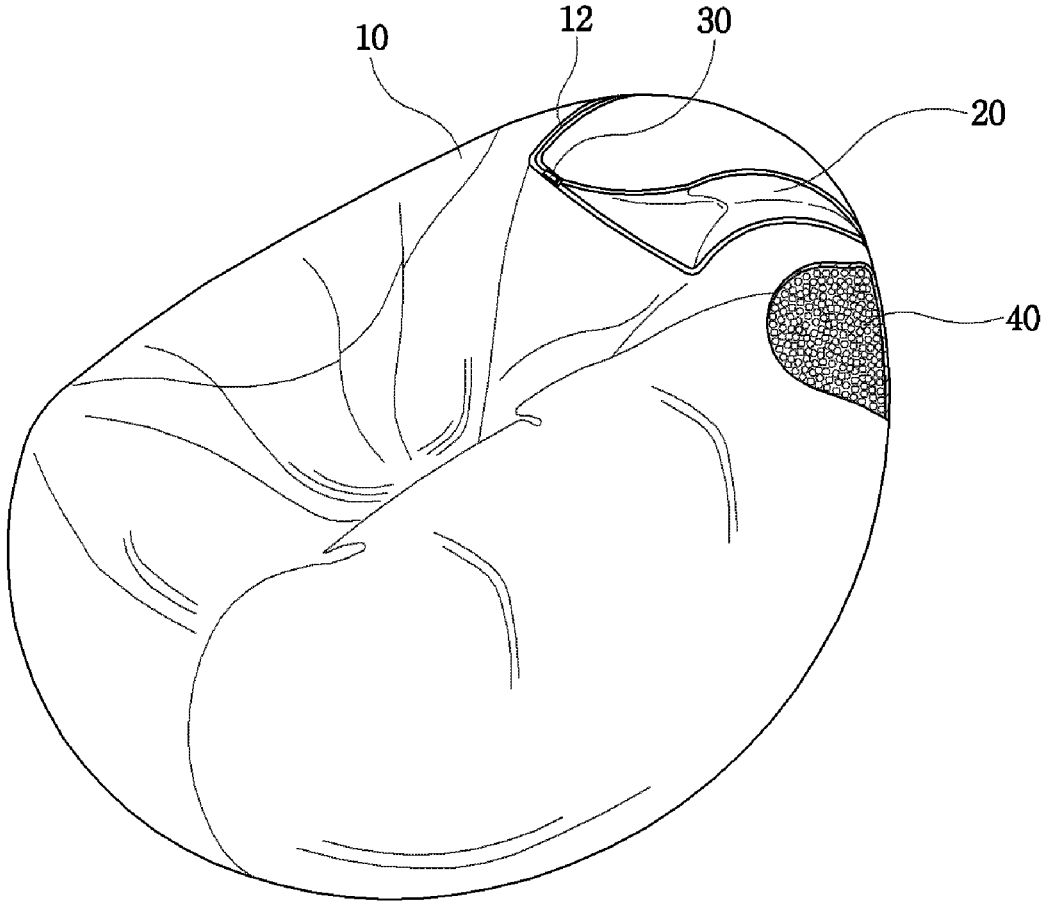
FIG. 1 is a perspective view showing the configuration of a beanbag sofa with a retractable headrest according to a first embodiment of the present invention.

| <Explanation of Reference Numerals for Major Portions Shown in Drawings> | |
|---|---|
| 10: | Outer Cover |
| 12, 14: | Cutting Portion |
| 20, 22: | Auxiliary Outer Cover |
| 30, 32: | Open/Close Member |
| 40: | Filling Material |

DESCRIPTION OF THE PREFERRED EMBODIMENT

Hereinafter, preferred embodiments of the present invention will be described in detail with reference to the accompanying drawings.

Figure 2:
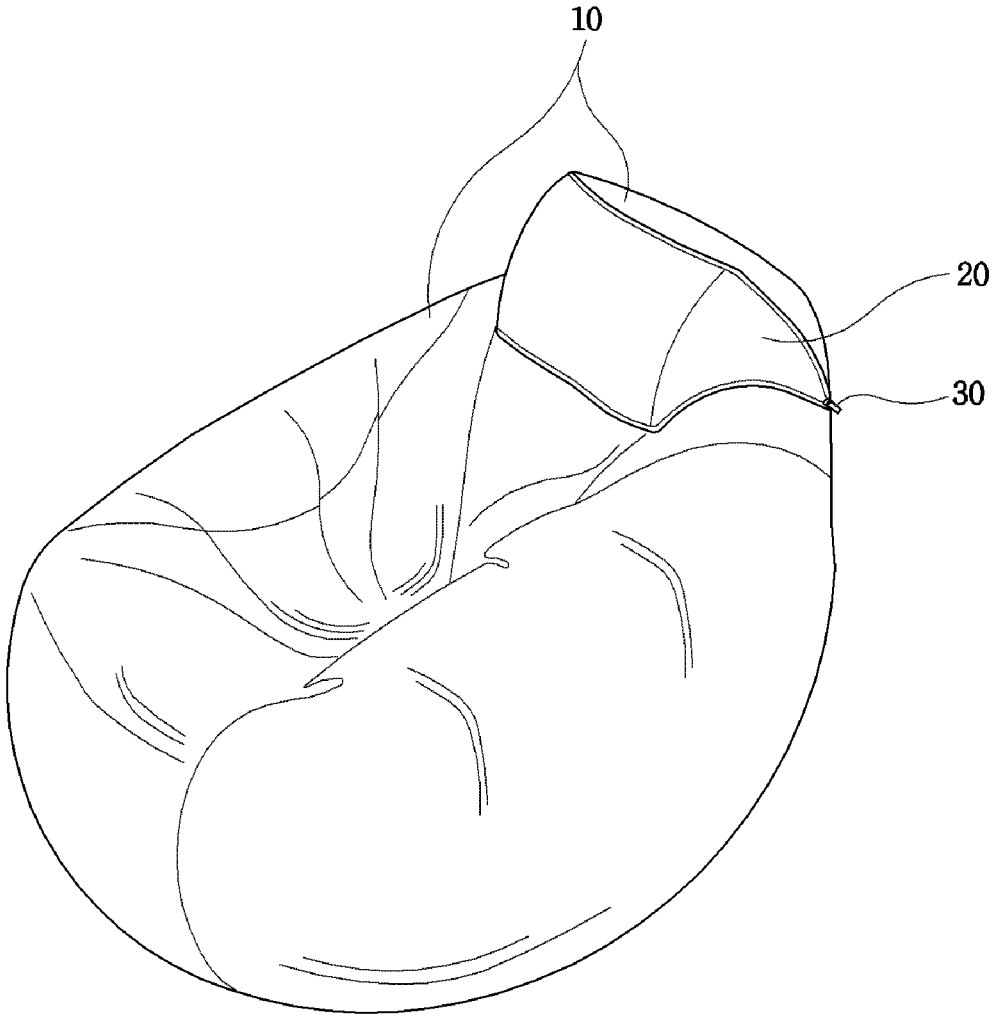
FIG. 2 is a perspective view showing a modified state of an external shape of the beanbag sofa with the retractable headrest according to the first embodiment of the present invention.

FIG. 1 is a perspective view showing the configuration of a beanbag sofa with a retractable headrest according to a first embodiment of the present invention; and FIG. 2 is a perspective view showing a modified state of an external shape of the beanbag sofa with the retractable headrest according to the first embodiment of the present invention.

Referring to FIGS. 1 and 2, the beanbag sofa with the retractable headrest according to the first embodiment of the present invention is configured to include an outer cover 10 for defining an external shape of the beanbag sofa and formed with a U-shaped cut portion 12 at a position of the outer cover with which the head of the user is in contact when the user sits on the beanbag sofa; an auxiliary outer cover 20 configured to be connected to the cut portion 12 of the outer cover 10 and to be received in the outer cover 10 or protrude therefrom; an open/close member 30 connected to the cut portion 12 formed in the outer cover 10 to receive the auxiliary outer cover 20 in the outer cover 10 or expose the auxiliary outer cover 20; and a filling material 40 filled in the outer cover 10. When the user sits on the beanbag sofa with the open/close member 30 open, the filling material 40 is introduced into the auxiliary outer cover 20, so that the auxiliary outer cover protrudes to form the headrest.

The outer cover 10 has a large size enough for the user to sit or lean thereon and is configured to have a circular or oval shape so that when the user sits on the sofa with the filling material 40 received in the outer cover, a central body portion of the outer cover with which the hip of the user is in contact is depressed downwards.

The outer cover 10 may be made of a flexible fabric having excellent ventilation and hygroscopicity. Since the outer cover is directly contacted with the skin of a user, the outer cover 10 may be made of an air-mesh type fabric so that it may not be unpleasant with sweat or moisture even if the user uses the beanbag sofa according to the present invention for a long time. Alternatively, the outer cover 10 may be made of a water-repellent and waterproof processed nylon or artificial leather in order to be used outdoors.

The outer cover 10 has the U-shaped cut portion 12 formed at a portion thereof with which the head of the user is in contact, and one side of the cut portion 12 is configured to be connected to the outer cover 10.

In addition, the outer cover 10 may be further provided with an open/close means (not shown) for separating the filling material 40 from the outer cover 10. Such a configuration may allow the filling material 40 to be separated from the outer cover 10 to clean the outer cover 10, thereby keeping the outer cover 10 clean.

The auxiliary outer cover 20 is connected to the cut portion 12 of the outer cover 10 by sewing or the like, so that the interior of the auxiliary outer cover 20 may communicate with that of the outer cover 10. Therefore, the auxiliary outer cover 20 may be configured to be received in the outer cover 10 in a folded state or three-dimensionally protrude out of the outer cover 10 to be used as a headrest by introducing the filling material 40 into the interior of the auxiliary outer cover 20.

The open/close member 30 is formed along the cut portion 12 of the outer cover 10, i.e., along a boundary portion between the outer cover 10 and the auxiliary outer cover 20, so that upon closing the open/close member 30, the auxiliary outer cover 20 may be received in the outer cover 10 by closing the cut portion 12. On the other hand, upon opening the open/close member 30, the auxiliary outer cover 20 may be exposed out of the outer cover 10.

A zipper, a Velcro tape or a button/buttonhole combination may be used as the open/close member 30.

The filling material 40 comprises particles of expandable polystyrene, expandable polypropylene, or the like. Such particles of the filling material 40 formed in the shape of beads are harmless to a human body, light in weight and elastic, and have an excellent water-proof, heat-insulting, sound-proof and shock-absorbing property. Therefore, these particles may be widely used as a packing material, a shock-absorbing material for packing, a building material, and the like by conventional press molding thereof. These particles may give a feeling of tight fitting due to its non-repelling property unlike an elastic material such as cotton, sponge, or the like. Even if there is a disadvantage in that the volume decreases depending on the use time of the beanbag sofa, the original state thereof may be maintained during a semi-permanent period by replenishing these particles. As a result, there is an advantage in that even if the elastic property of the beanbag sofa decreases due to the long-term use of the beanbag sofa, the filling material 40 may be replenished only as required without totally replacing the filling material 40, thereby reducing the maintenance cost.

The particles of expandable polystyrene are used as the filling material 40 according to this embodiment. Since the particles of expandable polystyrene are formed in the shape of particle-type beads and tend to be separately distributed upon the application of a pressure, they may be easily introduced into the auxiliary outer cover 20 depending on the movement of the body of the user after the user sits on the beanbag sofa. As a result, since the auxiliary outer cover 20 three-dimensionally protrudes outwards to form a headrest, the height of the sofa itself may be more or less lowered and therefore the angle between the upper part and the lower part of the body of the user may increase, so that the user may keep a comfortable posture.

Further, the outer cover 10 may be directly filled with the filling material 40. Alternatively, an additional inner cover (not shown) may be filled with the filling material 40 and then the inner cover may be received in the outer cover 10. The latter may facilitate the separation of the filling material 40 from the outer cover 10 and prevent the filling material 40 from being spilled outwards upon the breakage of the outer cover 10. The inner cover may be made of a mesh fabric having an excellent ventilation and durability. Since a relatively large load is applied to the inner cover when the user sits or leans on the sofa, the inner cover should have a durability so as to prevent the inner cover from being torn or burst.

Figure 3:
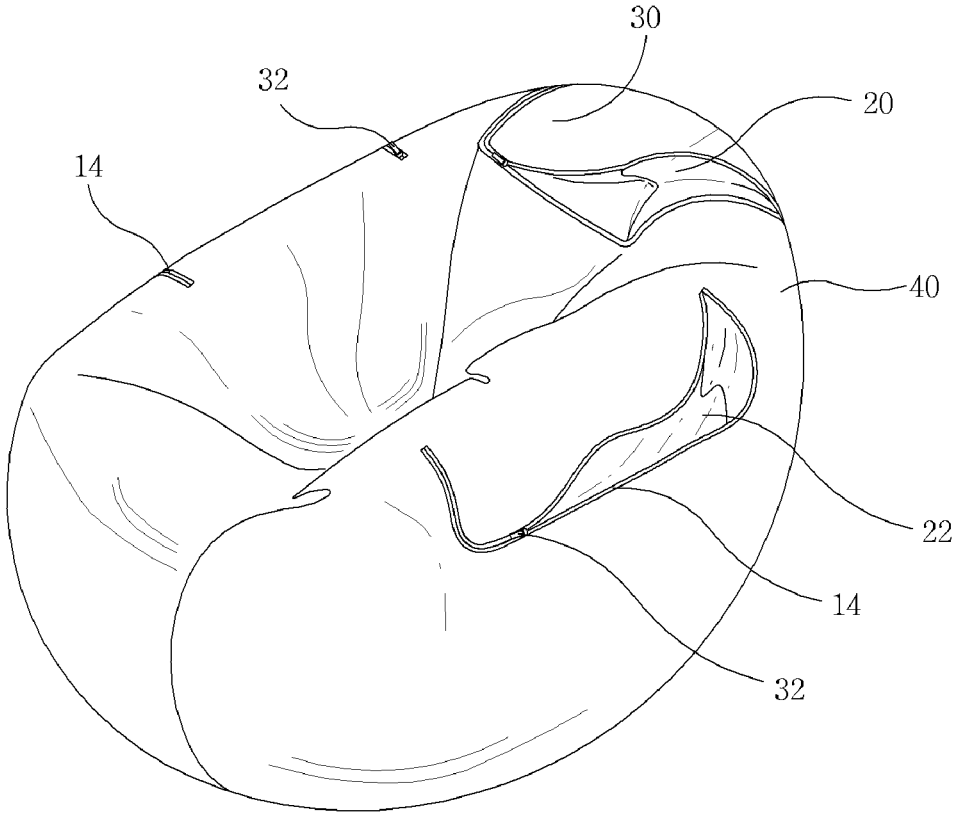
FIG. 3 is a perspective view showing the configuration of a beanbag sofa with a retractable headrest according to a second embodiment of the present invention.

FIG. 3 is a perspective view showing the configuration of a beanbag sofa with a retractable headrest according to a second embodiment of the present invention.

Referring to FIG. 3, the beanbag sofa with the retractable headrest according to the second embodiment of the present invention is configured to include an outer cover 10 for defining an external shape of the beanbag sofa and has three U-shaped cut portions 12 and 14 formed at positions of the outer cover 10 with which the head and both arms of a user are in contact when the user sits on the beanbag sofa, respectively; three auxiliary outer covers 20 and 22 configured to be connected to the cut portions 12 and 14 of the outer cover 10, respectively, and to be received in the outer cover 10 or protrude therefrom; three open/close members 30 and 32 connected to the cut portions 12 and 14 formed in the outer cover 10 to receive the auxiliary outer covers 20 and 22 in the outer cover 10 or expose the auxiliary outer covers 20 and 22, respectively; and a filling material 40 filled in the outer cover 10. When the user sits on the beanbag sofa with the open/close members 30 and 32 open, the filling material 40 is introduced toward the auxiliary outer covers 20 and 22, so that the auxiliary outer covers 20 and 22 protrude.

In the second embodiment of the present invention, the three cut portions 12 and 14 formed in the outer cover 10 are formed at predetermined angles with respect to a central body portion of the outer cover 10, so that the cut portions 12 and 14 may be formed at positions with which the head and both arms of the user are in contact when the user sits on the beanbag sofa, respectively.

In other words, when the user sits on the beanbag sofa with all the cut portions 12 and 22 open, the filling material 40 within the outer cover 10 is introduced toward the auxiliary outer covers 20 and 22, so that the auxiliary outer covers 20 and 22 are configured to three-dimensionally protrude out of the outer cover 10 to be used as the headrest and the armrests, respectively. At this time, since the filling material 40 within the outer cover 10 is introduced into the three auxiliary outer covers 20 and 22, the filling density of the filling material 40 within the outer cover 10 becomes lower as compared with a case where only the headrest is formed. As a result, the height of the sofa itself is further lowered, so that the user may keep a more comfortable posture.

Since such a configuration may allow the user to selectively open/close the headrest-side open/close member 30 or the armrest-side open/close member 32, there is another advantage capable of further improving the user's convenience in that the headrest and the armrests are selectively formed as required.

Hereinafter, it will be described how to use the beanbag sofa with the retractable headrest according to the present invention.

Figure 4:
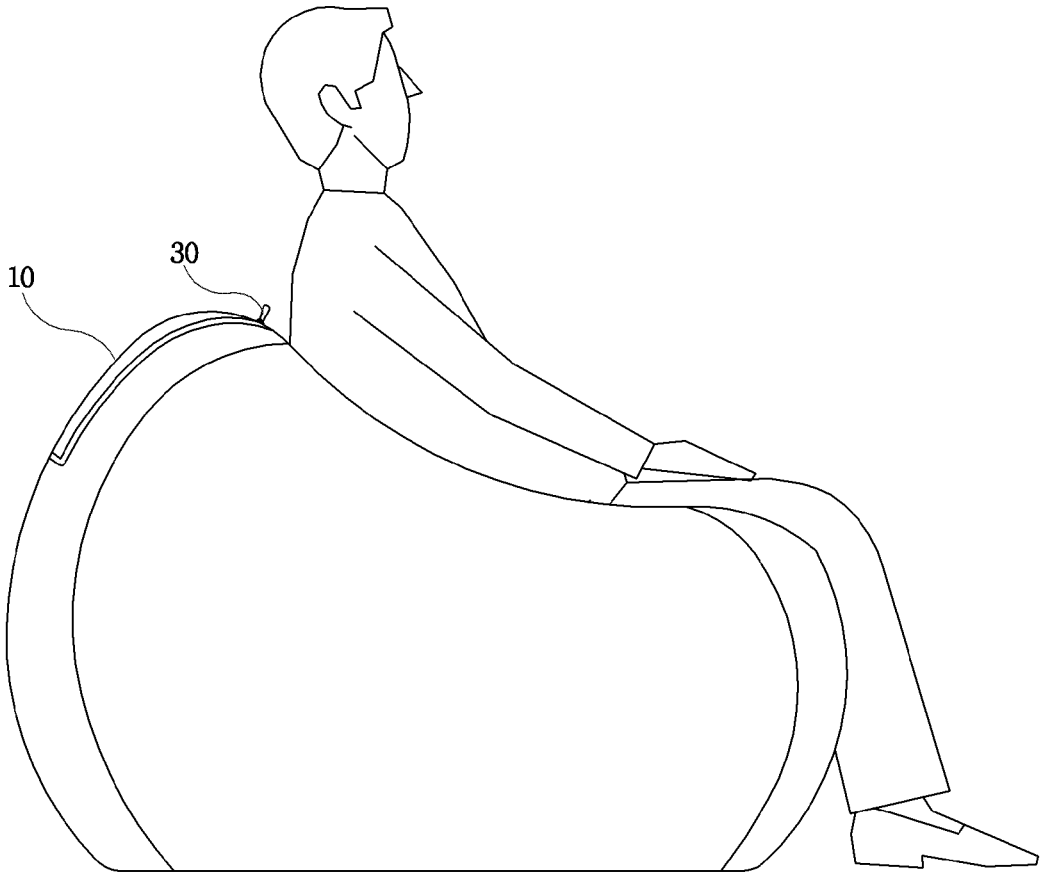
FIGS. 4 and 5 are side views showing usage states for the beanbag sofa with the retractable headrest according to the first embodiment of the present invention.
Figure 5:
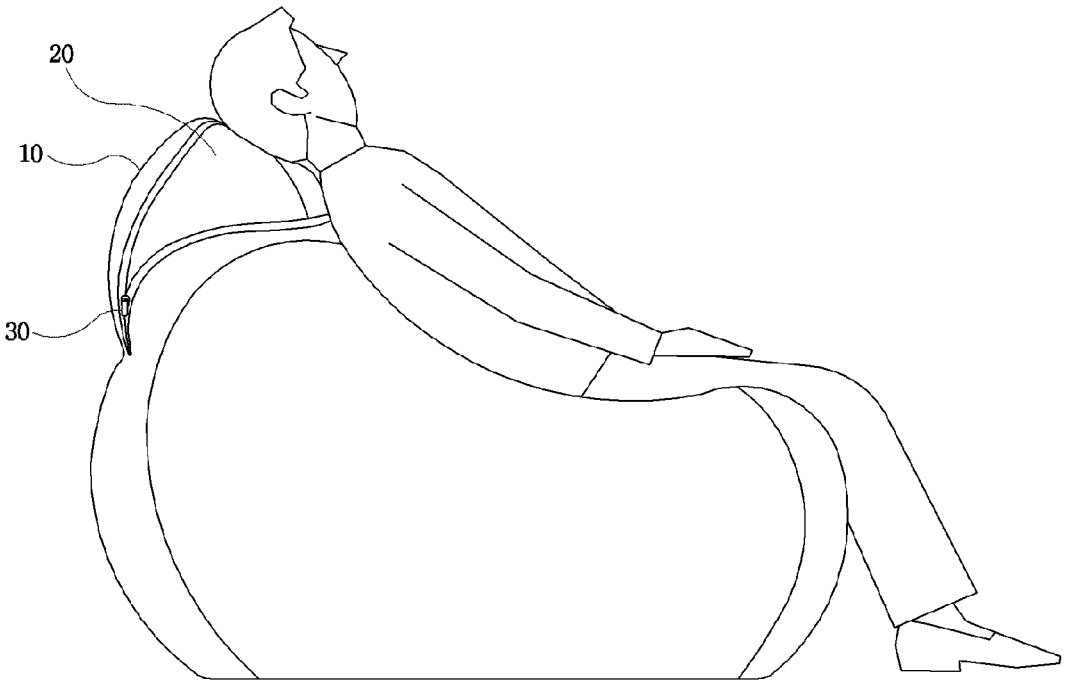
Figure 6:
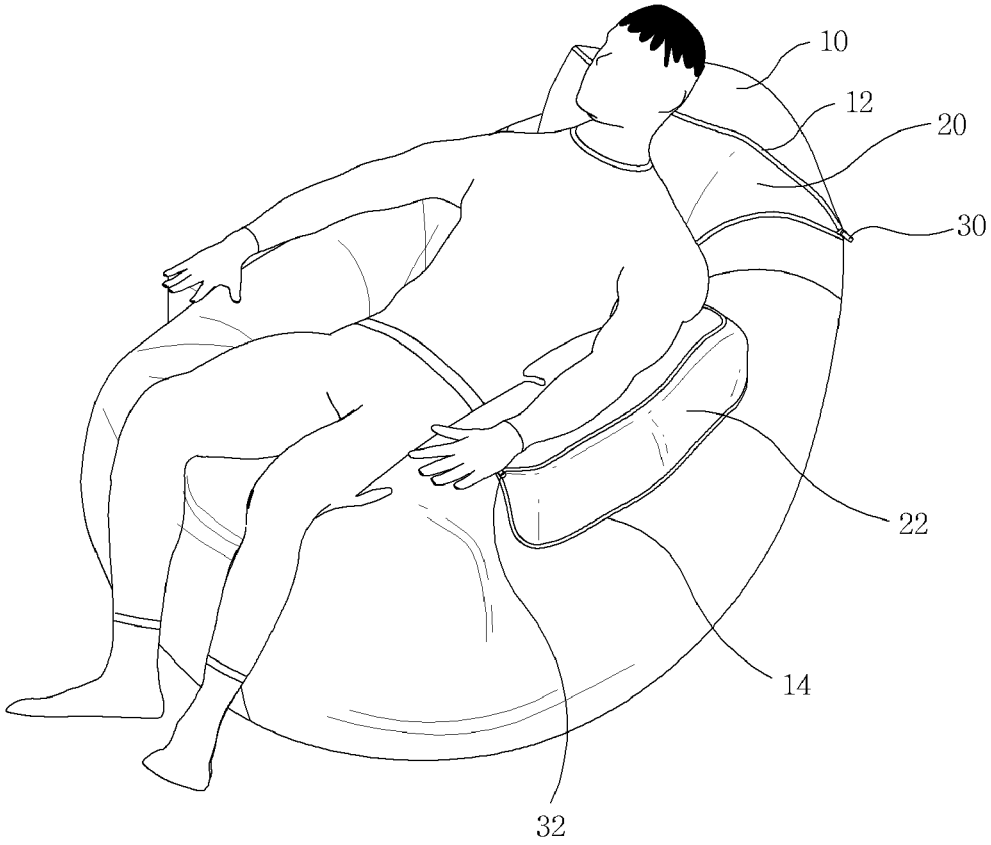
FIG. 6 is a perspective view showing a usage state for the beanbag sofa with the retractable headrest according to the second embodiment of the present invention.

FIGS. 4 and 5 are side views showing usage states for the beanbag sofa according to the first embodiment of the present invention; and FIG. 6 is a perspective view showing a usage state for the beanbag sofa according to the second embodiment of the present invention.

FIG. 4 shows a state where a user sits on the beanbag sofa according to the first embodiment of the present invention, wherein the open/close member 30 formed in the outer cover 10 has been closed.

FIG. 5 shows another state where the user sits on the beanbag sofa when the open/close member 30 positioned in a portion of the head of the user has been open.

When the open/close member 30 turns to be open, the auxiliary outer cover 20 received in the outer cover 10 is exposed outwards. Then, a pressure applied by the user who sits on the sofa allows the filling material 40 filled in the outer cover 10 to be moved toward the auxiliary outer cover 20, so that the auxiliary outer cover 20 may three-dimensionally protrude to form the headrest. At this time, since the filling material 40 is moved toward the auxiliary outer cover 20, the filling density of the filling material 40 within the outer cover 10 is lowered, so that the height of the sofa itself may be lowered. As a result, the angle between the upper part and the lower part of the body of the user increases, so that the user may have a comfortable posture. Further, since the head of the user may lean against the headrest formed on the beanbag sofa, the user may have a more comfortable posture.

In addition, FIG. 6 shows a state where a user sits on the beanbag sofa according to the second embodiment of the present invention when all the open/close members 30 and 32 positioned at portions with which the head and both arms of the user are in contact have been open.

Similarly to the first embodiment as described above, when all the open/close members 30 and 32 turn to be open, the auxiliary outer covers 20 and 22 are exposed outwards. Further, a pressure applied by the user who sits on the sofa allows the filling material 40 filled in the outer cover 10 to be moved toward the auxiliary outer covers 20 and 22, so that the auxiliary outer covers 20 and 22 may three-dimensionally protrude to form the headrest and the armrests, respectively. At this time, since the filling material 40 is moved toward the auxiliary outer covers 20 and 22 formed at portions in which the head and both arms are positioned, the filling density of the filling material 40 within the outer cover 10 is further lowered as compared with the case where only the headrest is formed as illustrated in FIG. 5, so that the height of the sofa itself may be further lowered. As a result, the further lowered filling density of the filling material 40 within the outer cover 10 and the armrests may allow the user to feel comfortable.

Although the specific embodiments have been described herein, it may be possible that various modifications and changes can be made thereto without departing from the scope of the invention. Therefore, the true scope of the present invention should not be limited to the illustrated embodiments, but should be defined by the technical spirit of the appended claims and the equivalence thereof.

The beanbag sofa with the retractable headrest according to the present invention may be applied to furniture industry, interior design industry, and the like, so that the beanbag sofa may be used to utilize a space efficiently and to contribute to the user's convenience.

What is claimed is:

1. A beanbag sofa with a retractable headrest, comprising:

an outer cover for defining an external shape of the beanbag sofa, the outer cover having three U-shaped cut portions respectively formed at three positions of the outer cover with which the head and both arms of a user are in contact when a user sits on the beanbag sofa;

three auxiliary outer covers respectively connected to the U-shaped cut portions to be received in the outer cover or protrude;

three open/close members formed along the U-shaped cut portions to receive the auxiliary outer covers in the outer cover or to expose the auxiliary outer covers, respectively; and a filling material filled in the outer cover, wherein when the user sits on the beanbag sofa with the auxiliary outer covers exposed by opening the three open/close members, respectively, the filling material is introduced toward the auxiliary outer covers to form the headrest and two armrests.

2. The bean bag sofa as claimed in claim 1, wherein the filling material comprises expandable polystyrene or expandable polypropylene.

3. The beanbag sofa as claimed in claim 2, wherein the open/close member comprises a zipper, a hook-and-loop fastener or a button/buttonhole combination.

* * * * *